US005807156A

United States Patent [19]

Owen

[11] Patent Number: 5,807,156

[45] Date of Patent: Sep. 15, 1998

[54] LUMINESCENT BOTTLE CAP

[76] Inventor: Peggy L. Owen, HCR 62, Box 770, Chatom, Ala. 36518

[21] Appl. No.: 838,509

[22] Filed: Apr. 8, 1997

[51] Int. Cl.[6] ..... A63H 33/22; A61J 9/00

[52] U.S. Cl. ..... 446/77; 446/219; 446/227; 446/267; 215/11.1; 215/227; 215/386

[58] Field of Search ..... 215/11.1, 11.6, 215/227, 228, 230, 386; 446/77, 219, 227, 267

[56] References Cited

U.S. PATENT DOCUMENTS

| | | | |
|---|---|---|---|
| 2,084,689 | 6/1937 | Karl | 215/11.6 |
| 2,409,820 | 10/1946 | Zimmern | 215/12.1 |
| 4,759,139 | 7/1988 | Ricks | 215/11.1 X |
| 4,832,214 | 5/1989 | Schrader et al. | 215/11.1 |
| 4,928,412 | 5/1990 | Nishiyama | 446/267 X |
| 5,092,807 | 3/1992 | Lew et al. | 446/219 |
| 5,104,699 | 4/1992 | Pantaleo et al. | 446/267 X |
| 5,114,374 | 5/1992 | Estiva | 446/77 |
| 5,165,781 | 11/1992 | Orak | 446/267 X |

*Primary Examiner*—John A. Ricci
*Attorney, Agent, or Firm*—Patent & Tratemark Services; Joseph H. McGlynn

[57] ABSTRACT

An attachment for baby bottles which fits around the nipple attached to such a bottle. The attachment is a ring which fits over a baby bottle nipple and is secured to the bottle itself. The ring, in one embodiment, has a double wall with objects made from luminescent material placed between the walls. Another embodiment has raised letters or a design placed on the outside surface of the attachment, which has a luminescent material inside the letters or design.

5 Claims, 1 Drawing Sheet

LUMINESCENT BOTTLE CAP

BACKGROUND OF THE INVENTION

This invention relates, in general, to infant feeding bottles, and, in particular, to a collar for the nipple which has portions with luminescent material to enable the bottle to be seen in the dark.

DESCRIPTION OF THE PRIOR ART

In the prior art various types of infant baby bottle attachments have been proposed. For example, U.S. Pat. No. 2,084,689 discloses a nipple protector which can be secured around a baby bottle nipple to protect the nipple from dirt.

U.S. Pat. No. 2,409,820 discloses a baby bottle cover which also serves to hold the bottle upright and also serves as a pillow or neck support for the infant.

U.S. Pat. No. 4,832,214 discloses a nipple retaining collar for a baby bottle which is made from a luminescent material so the bottle can be seen in the dark.

U.S. Pat. No. 5,144,374 discloses a decorative attachment for improving the appearance of a baby bottle.

SUMMARY OF THE INVENTION

The present invention pertains to an attachment for baby bottles which fit around the nipple attached to such a bottle. The attachment is a ring which fits over a baby bottle nipple and is secured to the bottle itself. The ring, in one embodiment, has a double wall with objects made from luminescent material placed between the walls. Another embodiment has raised letters or a design placed on the outside surface of the attachment, which has a luminescent material inside the letters or design.

It is an object of the present invention to provide a new attachment for baby bottles which has luminescent material to make the baby bottle visible at night.

It is an object of the present invention to provide a new attachment for baby bottles which is attractive to infants.

It is an object of the present invention to provide a new attachment for baby bottles which is safe and non-toxic to infants.

These and other objects and advantages of the present invention will be fully apparent from the following description, when taken in connection with the annexed drawings.

DESCRIPTION OF THE PREFERRED EMBODIMENT

Figure 1:
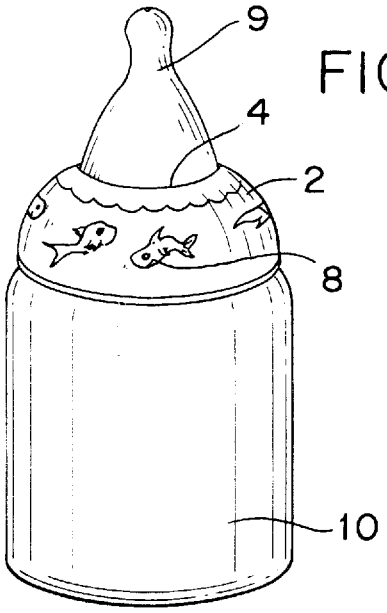
FIG. 1 is a side view of the present invention attached to a baby bottle.
Figure 2:
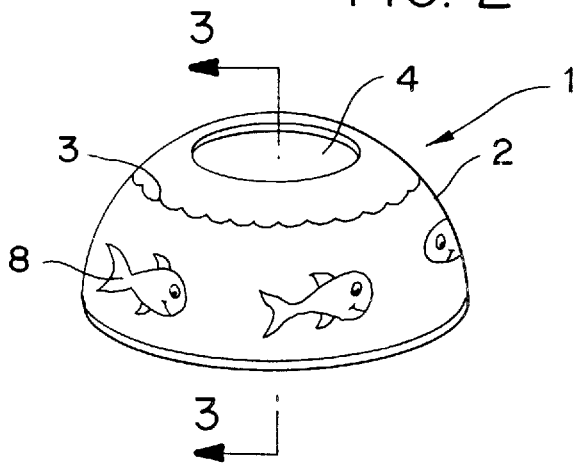
FIG. 2 is a side view of one embodiment of the present invention.
Figure 3:
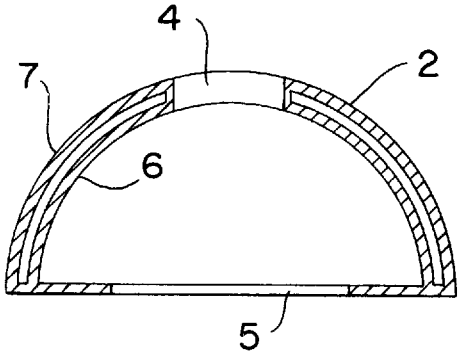
FIG. 3 is a cross-sectional view of the FIG. 2 embodiment.

Referring now to the drawings in greater detail, FIG. 1 shows the present invention 1 attached to a baby feeding bottle 10. As shown in FIGS. 1 and 2, the attachment 1 is a cover 2 which has an aperture 4 in its upper surface through which a nipple 9 can protrude. As shown in FIG. 3, the cover 2 has an inner wall 6 and an outer wall 7 with a space there between. The space will be filled with a non-toxic liquid such as, but not limited to, water 3. Also placed within the space between the walls 6, 7 will be a number of objects such as, but not limited to, animals, numbers, letters, flowers or FIGS. 8. The animals, numbers, or FIGS. 8 will be made from a luminescent material capable of absorbing light from artificial or natural sources, such as light bulbs or the sun. The material would retain and emit the light for an extended period of time.

This light retaining and emitting ability would allow the infant, or a parent, to locate the bottle in the dark. On occasion a parent will not want to turn on lights in a baby's room after the baby is in bed. However, when an infant looses his/her nursing bottle in the dark, the infant might not fall asleep until the bottle is found. Since this can be difficult in the dark, the luminescent material would allow the parent or the infant to locate the bottle without turning on the lights.

In addition, the bottle would be easier to find and/or use when traveling at night with an infant, as well as during 2:00 AM feedings. Also, the bottle would be easier for a parent to find if an infant dropped the bottle and it rolled under a piece of furniture.

Although, this basic concept, i.e. material, is well known, it is imperative that the baby be prevented from coming into contact with the luminescent material itself. For example the patent to Schrader et al (4,832,214) discloses a retaining ring which is made from a luminescent material. However, the entire material of the collar is made from this material, and the infant might ingest some of this material by chewing on the collar.

This problem is at least lessened and perhaps eliminated by the present invention. By placing the luminescent material 8 within a double wall enclosure 6, 7, it is less likely that the infant can chew through the walls 6, 7, which are made from a completely non-toxic material, and reach the luminescent material 8 within the walls. If an infant does chew the walls, this will become obvious to the parents before the infant can reach the luminescent material 8, and the parents can replace the collar. Therefore, the present invention adds an extra measure of safety to the "glow in the dark" bottle that is not present in the prior art devices such as Schrader et al.

In addition, by placing the objects 8 within a liquid 3 the object will move as the baby handles the bottle. This will attract their attention and will help calm the baby.

Figure 5:
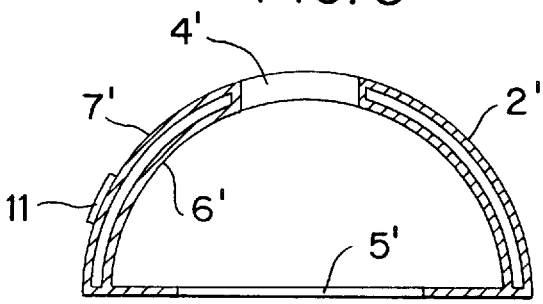
FIG. 5 is a cross-sectional view of the FIG. 4 embodiment.

The collar 2 of the present invention, as shown in FIGS. 3 and 5 has a second aperture 5, 5' which will fit over the top of a standard baby feeding bottle. Since the material of the collar 2 is resilient, the collar will snap over the top of the bottle and will retain itself thereon. Also, the collar 2 can serve, not only as a decorative and useful addition, but it can also be used to retain the nipple on the baby bottle by capturing the nipple and fastening it to the bottle due to the resiliency of the material of the collar 2. This will eliminate the need to have a screw threaded ring as shown in the patent to Estiva (5,114,374).

Figure 4:
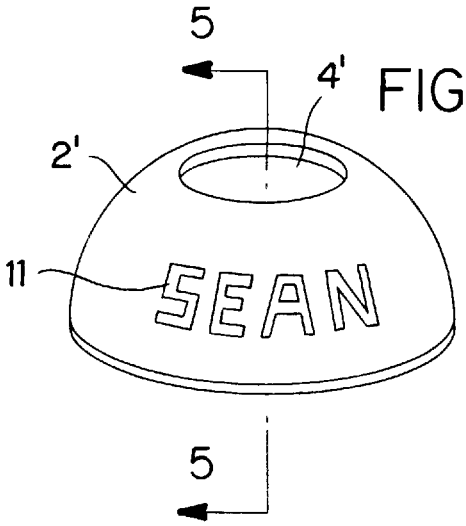
FIG. 4 is a side view of a second embodiment of the present invention.

In a second embodiment of the present invention as shown in FIGS. 4 and 5, the collar 2' is essentially the same as the FIG. 2 embodiment except the outer wall 7' has a raised surface 11 attached thereto. The raised surface can be in the form of the baby's name or some other design such as an animal or flower. By raising the surface 11, and placing the luminescent material within the raised surface, the bottle will be visible at night even if the bottle falls with the raised surface facing downward. Since the surface 11 is raised away from the outer wall the luminescent material will glow through the sides of the raised surface as well as through the top or front.

In addition, the two embodiments could be combine into one device if desired. That is the water filled collar 2 could also have the raised surface 11 of the FIG. 4 embodiment. This would make the bottle easier to see in the dark and it would personalize the bottle for each infant.

Although the Luminescent Bottle Cap and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An attachment for a baby bottle comprising:

a ring having a top and bottom and side walls, said ring having an aperture in said top and bottom, said side walls having an inner and an outer wall with a space between said inner and outer walls, liquid at least partially filling said space, objects in said liquid, said objects being made from a luminescent material.

2. The attachment for a baby bottle as claimed in claim 1, wherein said ring is made from a resilient material.

3. The attachment for a baby bottle as claimed in claim 1, wherein said liquid is water.

4. The attachment for a baby bottle as claimed in claim 1, wherein said objects are selected from the group consisting of animals, numbers, letters, flowers or figures.

5. The attachment for a baby bottle as claimed in claim 1, wherein said outer wall has a raised surface, said raised surface containing a luminescent material.

* * * * *